United States Patent [19]

Cavagnero et al.

[11] 4,028,007

[45] June 7, 1977

[54] PROPELLER FAN

[75] Inventors: Erman V. Cavagnero, Torrington; Ashok Z. Patel, Avon, both of Conn.

[73] Assignee: Torin Corporation, Torrington, Conn.

[22] Filed: Aug. 18, 1975

[21] Appl. No.: 605,765

[52] U.S. Cl. ..... 416/212 R; 416/214 R; 416/DIG. 3

[51] Int. Cl.² ..... F04D 29/34

[58] Field of Search ..... 416/DIG. 3, 212, 210, 416/132 A, 213 A, 214

[56] References Cited

UNITED STATES PATENTS

| | | | |
|---|---|---|---|
| 1,096,079 | 5/1914 | Viall | 416/212 |
| 1,180,916 | 4/1916 | Goss | 416/DIG. 3 |
| 1,508,086 | 9/1924 | Crawford | 416/212 X |
| 1,781,960 | 11/1930 | Schultz | 416/212 |
| 1,818,607 | 8/1931 | Campbell | 416/212 X |
| 1,835,913 | 12/1931 | Squires | 416/213 A |
| 2,906,349 | 9/1959 | Hans et al. | 416/135 |
| 3,302,867 | 2/1967 | Roffy | 416/DIG. 3 X |
| D192,564 | 4/1962 | Atalla | 416/DIG. 3 |

*Primary Examiner*—Everette A. Powell, Jr.
*Attorney, Agent, or Firm*—McCormick, Paulding & Huber

[57] ABSTRACT

A propeller fan comprising a pair of similar sheet metal spider-blade members each having a flat central hub section and two right angularly arranged pairs of narrow radially outwardly projecting spider arms. Each spider arm is twisted at an intermediate portion so that radially outer end portions of the arms of each pair are inclined in opposite directions relative to the hub section. A pair of air moving blades are formed integrally at inner end portions respectively with the outer end portions of the spider arms of one of the pairs of arms. A pair of laterally projecting blade support members are integrally formed respectively with the outer end portions of the other pair of spider arms. Each blade support member is approximately twice as wide as each spider arm and each blade is approximately four times as wide as each spider arm. The width and length of each blade are approximately equal. The two spider-blade members are right angularly arranged with the hub sections and spider arms in contiguous face-to-face relationship and the lateral support members of one member in face-to-face engagement with and supporting inner end portions of the blades of the other member. Spot welding at spaced areas throughout the hub section, the spider arms, and the support members and blades secures the two spider-blade members in operative relationship to form the propeller fan.

10 Claims, 3 Drawing Figures

PROPELLER FAN

BACKGROUND OF THE INVENTION

Propeller fans with relatively wide but short blades have performance characteristics which are highly desirable for certain applications. Such fans require a substantial degree of structural strength particularly throughout the hub sections, spider arms, and at inner portions of the blades. Accordingly, it has been a conventional practice to provide a separate fan spider of a relatively heavy gauge sheet metal and to provide in addition four separate sheet metal blades, the latter being attached at inner end portions to the spider and in some instances being constructed of a relatively lighter gauge sheet metal. Thus, even in cases where the same gauge sheet metal is used for spider and blades, the separate steps of fabricating individual spiders and blades and thereafter fastening the blades to the spider at four discrete locations must be carried out. When the blades are made from a lighter gauge sheet metal than the associated spider, it is of course also necessary that two different gauges of sheet metal be provided.

SUMMARY OF THE INVENTION

It is the general object of the present invention to provide a propeller fan of the type mentioned which may be constructed throughout from sheet metal or the like of the same relatively light gauge, which has but two similar or identical parts as compared with the five parts of prior art constructions, and which is nevertheless equally as sturdy and reliable in use as prior art propeller fans.

A further object of the invention resides in the provision of an improved propeller fan construction wherein integral relatively broad blades and narrow spider arms are provided to accommodate the desired pitching of the blades at the spider arms without undesired deformation of the blades and accompanying loss of performance characteristics.

A still further object of the invention resides in the provision of a propeller fan construction as mentioned above wherein identical spider-blade blank members may be employed in the manufacture of propeller fans having various different blade pitch angles.

DETAILED DESCRIPTION OF THE PREFERRED EMBODIMENTS

Figure 1:
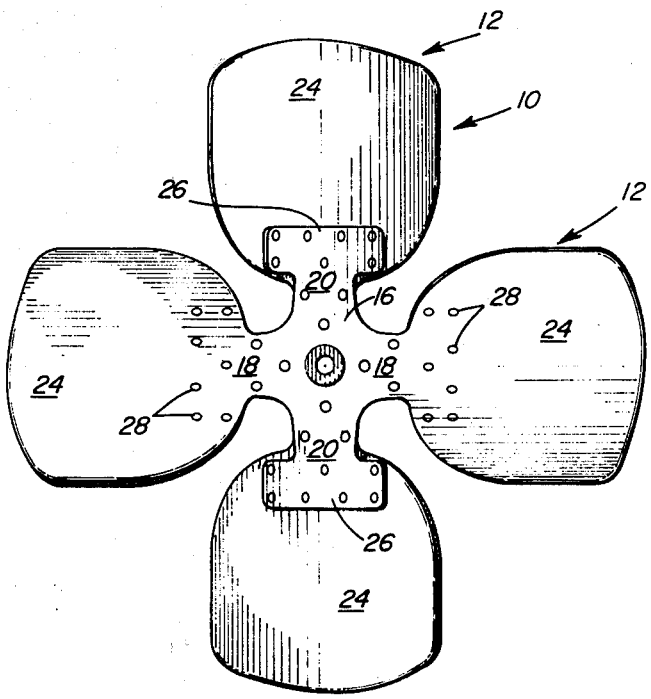
FIG. 1 of the drawings is a plan view of a propeller fan constructed in accordance with the present invention.
Figure 2:
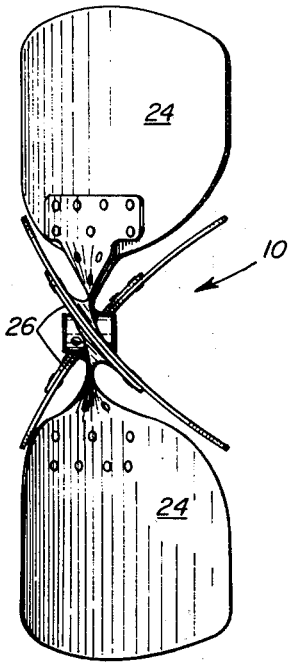
FIG. 2 is a side view of the propeller fan of FIG. 1.
Figure 3:
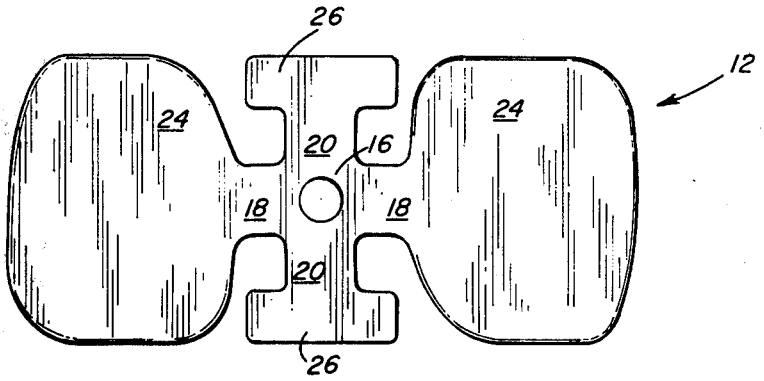
FIG. 3 is a plan view of a single spider-blade blank member employed in the manufacture of the propeller fan.

Referring particularly to FIGS. 1 and 2, it will be apparent that a propeller fan indicated generally at 10 comprises a pair of identical spider-blade members 12,12. In FIG. 3, a single blank or partially formed spider-blade member 12 is illustrated and may be regarded as representative of the spider blade members 12,12. Preferably, the members 12,12 are formed of sheet metal but plastic and other materials fall within the scope of the invention.

Each spider blade member 12 has a substantially flat centrally located hub section 16 and the hub sections 16,16 of the two members 12,12 are illustrated in FIGS. 1 and 2 in contiguous overlaying and face-to-face relationship in the assembled condition of the propeller fan. Formed integrally with each hub section 16 are two right angularly arranged pairs of relatively narrow radially outwardly projecting spider arms 18,18 and 20,20. As illustrated, each spider arm is integral and substantially coplanar with the hub section 16 at a radially inner end portion and, in its final formed condition, each spider arm 18, 20 is twisted at an intermediate portion so that radially outer end portions of the arms of each pair are inclined in opposite directions relative to the hub section, FIG. 2.

At the radially outer end portions of each of the arms 18,18 of one of the pairs of spider arms, a pair of air moving blades 24,24 are provided. The blades 24,24 are formed integrally respectively with the spider arms 18,18 and project radially outwardly therefrom. The blades are of relatively wide or broad configuration, as mentioned above. Pitching of the blades as desired is accomplished by the aforementioned twisting of the spider arms at intermediate portions and, accordingly, no deformation of the blades occurs, FIG. 2. Further, it will be apparent that the blade pitch is determined wholly by the amount or degree of twisting of the spider arms and that a single spider-blade blank design can be employed in providing propeller fans of varying degrees of blade pitch.

Referring again to FIG. 3, and more particularly to the spider arms 20,20, it will be observed that a pair of laterally projecting blade support members 26,26 are formed integrally with the arms. That is, each arm 20 has a laterally extending blade supporting member 26 formed integrally at its outer end portion and projecting radially outwardly and laterally with respect thereto.

Twisting of the arms 20,20 at intermediate portions is accomplished as with the arms 18,18 to pitch the members 26,26 for blade engagement and support.

When spider-blade members 12,12 are assembled in right angular relationship as in FIGS. 1 and 2 the support members 26,26 of one member engage and support the blades 24,24 of the other member as shown, the lateral support members 26,26 of the vertical spider-blade member 12 being disposed behind the blades 24,24 of the horizontal member 12 in FIG. 1. Thus, on attachment of the support members to the blades, the desired degree of structural strength and integrity is provided at inner blade portions. Attachment of the spider-blade members 12,12 in assembled relationship is preferably accomplished by welding and, as shown, several welded areas are provided in the form of a plurality of substantially similarly spaced spot weld 28,28. The spot welded areas 28,28 preferably extend throughout the contiguous areas between lateral support members 26,26 and blades 24,24, throughout the contiguous areas of the spider arms 18,18 and 20,20, and throughout the contiguous areas of the hub sections 16,16.

Various dimensional relationships of parts are contemplated within the scope of the invention. It is however important to maintain dimensional relationships within selected ranges. Thus, a relatively wide or broad and short blade configuration is desired and in order to provide for the necessary pitching of the blades without undesirable blade deformation a relatively narrow spider arm configuration is essential. That is, the width of the spider arms 18,18 and 20,20 must be substantially less than that of the blades 24,24 and, accordingly, blade width is at least twice the width of the spider arms.

As shown, and presently preferred, blade width is approximately four times the width of the spider arms. Each lateral blade support member 26 should be at least 50 percent greater in width than its associated spider arm 20 and, as shown, the width of each support member 26 is approximately twice that of the spider arm 20. Still further, the lateral extension of each support member 26 across its associated blade 24 should be at least one third the width of the blade and, preferably, the said support members extend across approximately one-half the width of the associated blade as illustrated. Finally, the blades 24,24 each have a width at least one third their length and as shown, the said blades are approximately equal in width and length.

The right angular relationship of the spide-blade members may also vary through a few degrees and even as much as 20 percent for improved sound attenuation. Thus, it is only essential to the invention that such relationship be "substantially" at right angles.

With the aforementioned dimensional relationships, it if found that a judicious compromise is achieved. A relatively light gauge sheet metal may be employed throughout, a simple two-piece propeller fan construction can be provided, and a high degree of structural integrity results particularly at the double thickness areas of the hub sections, spider arms, and between support members and blades. Further, the desired blade pitch can be readily provided for in a given fan design without undesirable deformation of the blades and performance loss and if desired, propeller fans having various blade pitches can be manufactured from a single stock of spider-blade blanks.

We claim:

1. A propeller fan comprising a pair of similar spider-blade members each having a substantially flat central hub section, two substantially right angularly arranged pairs of narrow radially outwardly projecting spider arms, each arm being integral with the hub section at a radially inner end portion and each arm being twisted at an intermediate portion so that radially outer end portions of the arms of each pair are inclined in opposite directions relative to the hub section, a pair of air moving blades integral at inner end portions respectively with the outer end portions of the spider arms of one of said pairs of arms, and a pair of laterally projecting blade support members integral respectively with said outer end portions of said other pair of spider arms; each spider arm having a length at least one-half its width, each lateral blade support member having a width at least 50 percent greater than each spider arm, each blade having a width at least twice the width of each spider arm, and each blade having a width at least one-third its length, and said two spider-blade members being right angularly arranged with their hub sections and spider arms in contiguous face-to-face relationship and with the lateral support members of one member in face-to-face engagement with and supporting inner end portions of the blades of the other member, and means fastening said hub sections, spider arms, support members and blades together, and all of said blades when so assembled having their pitch angles provided by the associated twisted arms with no deformation and no substantial change in pitch occurring throughout the length of the blades.

2. A propeller fan as set forth in claim 1 wherein each said lateral support member extends across at least one-third the width of its respective air moving blade.

3. A propeller fan as set forth in claim 2 wherein each said lateral support member extends across approximately one-half the width of its respective air moving blade.

4. A propeller fan as set forth in claim 2 wherein each air moving blade has a width approximately four times that of each spider arm.

5. A propeller fan as set forth in claim 2 wherein each air moving blade is approximately of equal width and length.

6. A propeller fan as set forth in claim 2 wherein each lateral support member is approximately twice as wide as each spider arm.

7. A propeller fan as set forth in claim 2 wherein said fastening means takes the form of welded areas between contiguous spider arms and between contiguous support members and blades.

8. A propeller fan as set forth in claim 2 wherein said fastening means takes the form of welded areas between contiguous hub sections and between contiguous support members and blades.

9. A propeller fan as set forth in claim 2 wherein said fastening means takes the form of welded areas between contiguous hub sections, spider arms, and support members and blades.

10. A propeller fan as set forth in claim 9 wherein said welded areas take the form of a plurality of substantially similarly spaced spot welds.

* * * * *